US005907872A

United States Patent [19]

Alberts et al.

[11] Patent Number: 5,907,872

[45] Date of Patent: Jun. 1, 1999

[54] PROCESS FOR MANUFACTURING SLEEVELESS TOPS, SHIRTS, OR BLOUSES

[75] Inventors: Joseph Richard Alberts, Menasha; Edward Anthony Drezdzon II, Appleton; Donald Merlin Fries, deceased, late of Combined Locks, by Sharon Fries; Richard Mark Konetzke, Menasha; Thomas Theodore Kvitek, Menasha; Michael Joseph Muhlebach, Menasha; Michael Joseph Nelson, Neenah; Gerald Leigh Rabe, Appleton; Brendon Frank Ribble, Menasha; James Frederick Roth, Appleton; Jon Mark Wittmann, Combined Locks, all of Wis.

[73] Assignee: Kimberly-Clark Worldwide, Inc., Neenah, Wis.

[21] Appl. No.: 08/841,989

[22] Filed: Apr. 8, 1997

[51] Int. Cl.[6] ..... A41D 27/00

[52] U.S. Cl. ..... 2/243.1; 2/109; 450/92

[58] Field of Search ..... 2/243.1, 1, 109, 2/114, 110, 104; 450/92, 156

[56] References Cited

U.S. PATENT DOCUMENTS

| | | | |
|---|---|---|---|
| 2,694,201 | 11/1954 | Carson . | |
| 2,707,284 | 5/1955 | Artzt . | |
| 3,156,927 | 11/1964 | Grimm et al. . | |
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,609,767 | 10/1971 | Grosz . | |
| 3,692,618 | 9/1972 | Dorschner et al. | 161/72 |
| 3,699,591 | 10/1972 | Breitkopf et al. . | |
| 3,802,817 | 4/1974 | Matsuki et al. | 425/66 |
| 3,849,241 | 11/1974 | Butin et al. | 161/169 |
| 4,041,203 | 8/1977 | Brock et al. | 428/157 |

(List continued on next page.)

OTHER PUBLICATIONS

American Society for Testing Materials (ASTM) Designation: D 1682–64 (Reapproved 1975), "Standard Test Methods for Breaking Load and Elongation of Textile Fabrics," pp. 454–459, published Oct. 1964.

American Society for Testing Materials (ASTM) Designation: D 1776–60 T, "Tentative Method of Conditioning Textiles And Textile Products For Testing," pp. 156–157, published 1960.

American Society for Testing Materials (ASTM) Designation: D 4157–92, "Standard Test Method for Abrasion Resistance of Textile Fabrics (Oscillatory Cylinder Method)," pp. 338–341, published Aug. 1992.

American Society for Testing Materials (ASTM) Designation: D 4158–92, "Standard test Method for Abrasion Resistance of Textile Fabrics (Uniform Abrasion Method)," pp. 342–347, published Aug. 1992.

TAPPI Official Test Method T 402 om–93, "Standard Conditioning and Testing Atmospheres for Paper, Board, Pulp Handsheets, and Related Products," published by the TAPPI Press, Atlanta, Georgia, revised 1993, pp. 1–3.

*Primary Examiner*—C. D. Crowder
*Assistant Examiner*—Shirra L. Jenkins
*Attorney, Agent, or Firm*—Patricia A. Charlier

[57] ABSTRACT

A continuous process for the manufacture of a camisole garment wherein the fabric is cut, defining openings that serve as arm holes in the finished garment. A portion of the fabric is folded back above the openings, defining shoulder straps. The camisole garment has a body seam that may be refastenable or non-refastenable.

30 Claims, 3 Drawing Sheets

U.S. PATENT DOCUMENTS

| | | | |
|---|---|---|---|
| 4,205,398 | 6/1980 | Blume . | |
| 4,340,563 | 7/1982 | Appel et al. | 264/518 |
| 4,388,075 | 6/1983 | Mesek et al. | 604/385 |
| 4,510,626 | 4/1985 | Bowditch . | |
| 4,606,964 | 8/1986 | Wideman | 428/152 |
| 4,657,802 | 4/1987 | Morman | 428/152 |
| 4,720,415 | 1/1988 | Vander Wielen et al. | 428/152 |
| 4,938,753 | 7/1990 | Van Gompel et al. | 604/385.2 |
| 4,938,754 | 7/1990 | Mesek | 604/385.2 |
| 4,940,464 | 7/1990 | Van Gompel et al. | 604/396 |
| 5,114,781 | 5/1992 | Morman | 428/198 |
| 5,116,662 | 5/1992 | Morman | 428/198 |
| 5,145,727 | 9/1992 | Potts et al. | 428/198 |
| 5,169,706 | 12/1992 | Collier, IV et al. | 428/152 |
| 5,178,931 | 1/1993 | Perkins et al. | 428/198 |
| 5,188,885 | 2/1993 | Timmons et al. | 428/198 |

PROCESS FOR MANUFACTURING SLEEVELESS TOPS, SHIRTS, OR BLOUSES

BACKGROUND OF THE INVENTION

This invention pertains to a continuous process for the manufacture of garments such as sleeveless tops, shirts, and blouses intended for everyday wear, and more particularly to a process for the manufacture of camisole-type garments.

Manufacturers are always looking for new, cost-effective, high-speed continuous processes for manufacturing inexpensive clothing, both disposable and reusable garments, for everyday use. In addition, consumers are interested in active wear that is comfortable and relatively inexpensive, especially if the garments are for children.

Previous methods used in clothing manufacture require pieces of fabric or similar such material to be cut into specific patterns. The pieces are then sewn together in a multi-step process for assembly into articles of clothing. Such processes are labor intensive. The process speeds typically depend on the speed of the final sewing stages.

In fitting the wearer, one form of the top manufactured by the present invention is a fully elasticized structure which extends from just about the top of the arm pit to just above the wearer's stomach or down to the waist of the wearer. One problem in the fit of the material, especially elasticized material, of tops manufactured by current processes occurs when the tops consists of a bulked web composite. The bottom edge of the top has a tendency to curl up and fold over. This creates a poor appearance, and the camisole garment tends to ride up on the wearer.

SUMMARY OF THE INVENTION

Thus, there is a need to provide a comfortable and inexpensive active wear clothing, specifically tops that minimize the bottom rollover tendency during wearing while maintaining proper coverage. In addition, the top needs to be easy to place on the wearer and durable during wear. In response to these needs, an improved cost-effective, high speed process for manufacturing a sleeveless garment, such as a top, shirt, or blouse, has been discovered.

One embodiment of the present invention is a continuous process for the manufacture of a camisole garment to be worn about the upper body comprising a body-covering assembly having an upper body opening and a lower body opening, each opening having an edge about its perimeter. The body covering assembly comprises a relatively elastic region between the upper edge and the lower edge. The body covering assembly includes a relatively inelastic lower edge region between the relatively elastic region and the lower edge, wherein the relatively inelastic lower edge region is from about 0.25 to about 4.0 inches in width. The body covering assembly includes a relatively inelastic upper edge region located between the relatively elastic region and the upper edge wherein the relatively inelastic upper edge region is from about 0.25 to about 4.0 inches in width.

Numerous features and advantages of the present invention will appear from the following description. In the description, reference is made to the accompanying drawings which illustrate desired embodiments of the invention. Such embodiments do not represent the full scope of the invention. Reference should therefore be made to the claims herein for interpreting the full scope of the invention.

BRIEF DESCRIPTION OF THE DRAWINGS

The above-mentioned and other features of the present invention and the manner of attaining them will become more apparent, and the invention itself will be better understood by reference to the following description of the invention, taken in conjunction with the accompanying drawings, wherein.

DEFINITIONS

Figure 1:
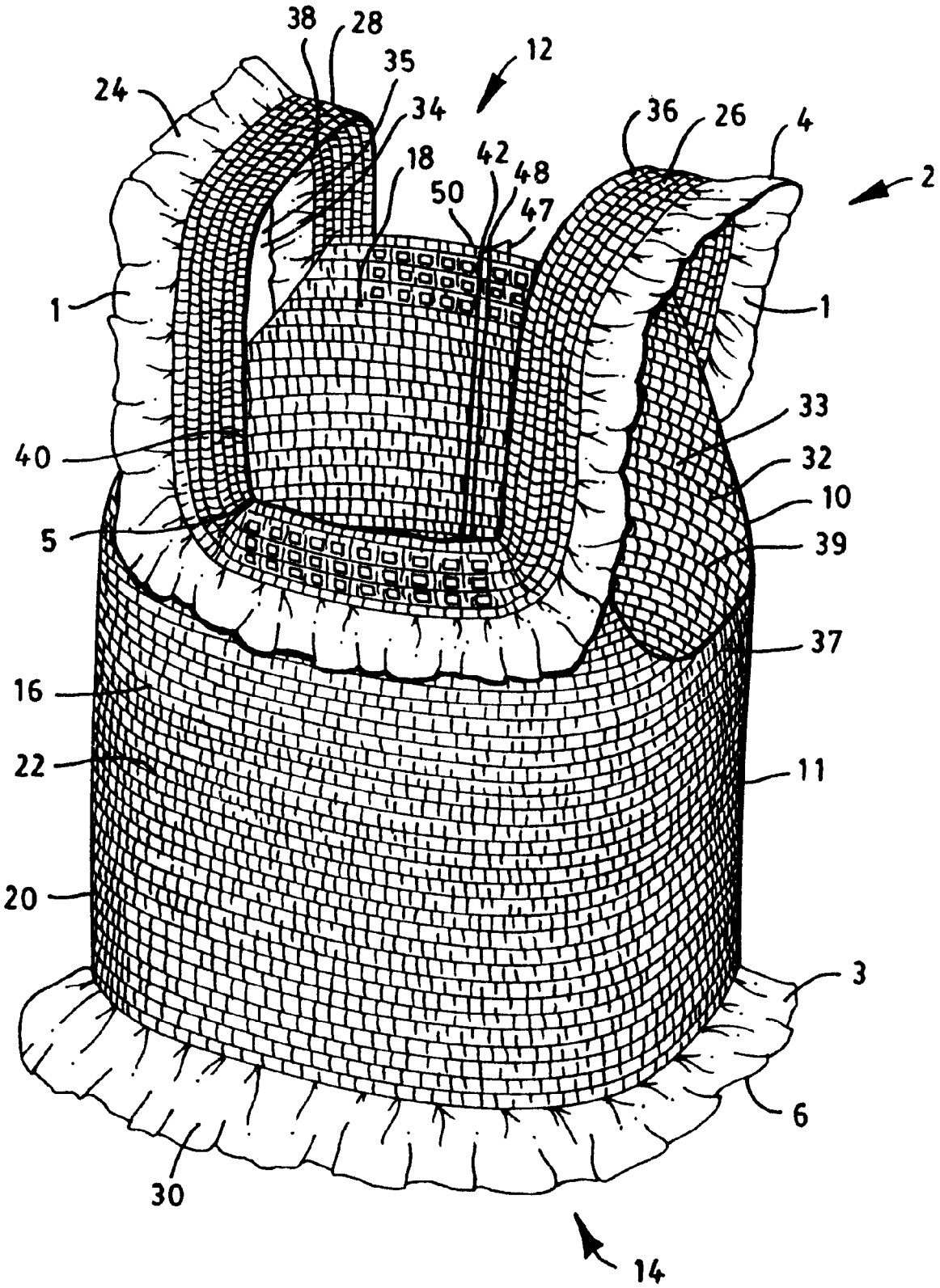
FIG. 1 is a front view of one embodiment of a camisole garment.

Within the context of this specification, each term or phrase below will include the following meaning or meanings:

(a) "Bonded" refers to the joining, adhering, connecting, attaching, or the like, of two elements. Two elements will be considered to be bonded together when they are bonded directly to one another or indirectly to one another, such as when each is directly bonded to intermediate elements.

(b) "Bonded Carded Fabric or Web" refers to fabric or webs made from staple fibers which are sent through a combing or carding unit, which breaks apart and aligns the staple fibers in the machine direction to form a generally machine direction-oriented fibrous nonwoven web. Such fibers are usually purchased in bales which are place in a picker which separates the fibers prior to the carding unit. Once the web or fabric is formed, it is then bonded by one or more of several known bonding methods. Once such bonding method is powder bonding, wherein a powdered adhesive is distributed through the web or fabric and then activated, usually by heating the fabric and adhesive with hot air. Another suitable bonding method is pattern bonding, wherein heated calender rolls or ultrasonic bonding equipment are used to bond the fibers together, usually in a localized bond pattern, though the fabric can be bonded across its entire surface if so desired. Another suitable and well-known bonding method, particularly when using bi-component staple fibers, is through-air bonding.

(c) "Cross Machine Direction" means the width of the fabric in a direction generally perpendicular to the machine direction.

(d) "Disposable" includes being disposed of after use, and not intended to be washed and reused.

(e) "Disposed", "disposed on", "disposed with", "disposed at", "disposed near", and variations thereof are intended to mean that one element can be integral or unitary with another element, or that one element can be a separate structure joined to or connected to or placed with or placed near another element.

(f) "Elasticity" and "elastic" include that property of a material by virtue of which it tends to substantially recover to its original size and shape after removal of a force causing deformation of the material.

(g) "Elastically connected" and "elastically connecting" refer to two elements being separated by and bonded to an elastic member, where the relative position of the two elements may change due to extension of the elastic member.

(h) "Elongation" includes the ratio of the extension of a material to the length of a material prior to the extension. Elongation is expressed in percent.

(i) "Extension", "extend", and "extended" include the change in length of a material due to stretching. Extension is expressed in units of length.

(j) "Fabric" is used to refer to all of the woven, knitted, and nonwoven webs.

(k) "Flexible" refers to materials or fabrics that are compliant and readily conform to the general shape and contours of an individual's body.

(l) "Force" includes a physical influence exerted by one body on another which produces acceleration of bodies that are free to move and deformation of bodies that are not free to move. Force is expressed in grams-force.

(m) "Foreshortened" and "foreshortening" include to shorten beforehand, that is, before a subsequent step.

(n) "Front" and "back" are used to designate relationships relative to the garment itself, rather than to suggest any position the garment assumes when it is positioned on a wearer.

(o) "Gatherable" material is one which, when bonded to the reticular web with the latter is under is under tension, will gather, with the formation of puckers or gathers, to accommodate contraction of the reticulated web upon release of the tensioning forces.

(p) "Machine Direction" means the length of a fabric in the direction in which it is produced or the length of fabric moving in the direction of the machine operations.

(q) "Meltblown Fibers" means fibers formed by extruding a molten thermoplastic material through a plurality of fine, usually circular, die capillaries as molten threads or filaments into converging high velocity, usually hot gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

(r) "Member" when used in the singular can have the dual meaning of a single element or a plurality of elements.

(s) "Multi-layer Laminate" means a laminate wherein some of the layers are spunbond and some are meltblown such as a spunbond/meltblown/spunbond (SMS) laminate and other as disclosed in U.S. Pat. No. 4,041,203 to Brock et al., U.S. Pat. No. 5,169,706 to Collier et al., U.S. Pat. No. 5,145,727 to Potts et al., U.S. Pat. No. 5,178,931 to Perkins, et al., and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy. Multi-layer laminates may also have various numbers of meltblown layers or multiple spunbond layers in many different configurations and may include other materials like films or coform materials.

(t) "Neckable Material" means any material which can be necked.

(u) "Necked Material" refers to any material which has been constricted in at least one dimension by processes such as, for example, drawing or gathering.

(v) "Non-elastic" or "Inelastic" refers to any material that does not fall within the definition of "elastic".

(w) "Nonwoven fabric or web" means a web having a structure of individual fibers or threads which are interlaid, but not in an identifiable manner as in a knitted fabric. Nonwoven fabrics or webs have been formed from many processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns.

(x) "Operatively joined" with reference to the attachment of an elastic member to another element means that the elastic member when attached to or connected to or treated with heat with the element gives that element elastic properties. With reference to the attachment of a non-elastic member to another element, it means that the member and element can be attached in any suitable manner that permits or allows them to perform the intended or described function of the joinder. The joining, attaching, connecting or the like can be either directly, such as joining either member directly to an element, or can be indirectly by means of another member or element disposed between the first member and the first element.

(y) "Pattern" includes any geometric or non-geometric form that can include, among others, a series of connected or unconnected lines or curves, a series of parallel or nonparallel or intersecting lines or curves, a series of linear or curvilinear lines, and the like, or any combinations thereof. The pattern can include a repeating form and/or non-repeating form.

(z) "Ruffles" includes the region of the material which lies outside the outermost elastic and includes no elastic material. That is, no elastic material is present or the elastic material which was present has been rendered inelastic.

(aa) "Rupture" includes the breaking or tearing apart of a material. In tensile testing, rupture refers to the total separation of a material into two parts, either all at once or in stages, or the development of a hole in some materials.

(bb) "Stretch bonded" refers to an elastomeric strand being bonded to another member while the elastomeric strand is elongated at least about 25 percent of its relaxed length. Desirably, the term "stretch bonded" refers to the situation wherein the elastomeric strand is elongated at least about 50 percent, and more desirably, at least about 300 percent, of its relaxed length when it is bonded to the other member.

(cc) "Stretch bonded laminate" ("SBL") refers to a composite material having at least two layers in which one layer is a gatherable layer and the other layer is a stretchable, that is, elastic, layer. The layers are joined together when the stretchable layer is in a stretched condition so that upon relaxing the layers, the gatherable layer is gathered.

(dd) "Spunbonded fibers" refers to small diameter fibers which are formed by extruding molten thermoplastic material as filaments from a plurality of fine, usually circular capillaries or spinneret with the diameter of the extruded filaments then being rapidly reduced as by, for example, as disclosed in in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

(ee) "Tension" includes a uni-axial force tending to cause the extension of a body or the balancing force within that body resisting the extension.

(ff) "Two-dimensional" refers to a garment, such as a diaper, that can be opened and laid in a flat condition without destructively tearing any structure. This type of garment does not have continuous leg and waist openings when opened and laid flat, and requires a fastening device, such as adhesive tapes, to attach the garment about the wearer.

(gg) "Three-dimensional" refers to a finished garment similar to shorts or pants in that they have continuous leg and waist openings that are bounded by the material of which the garment is made. This type of garment can be opened and laid flat only by destructively tearing it. This type of garment may or may not have manually tearable seams.

(hh) "Ultimate elongation" includes the elongation at the point of rupture.

These definitions may be supplemented with additional language in the remaining portion of the specification.

Detailed Description

Figure 2:
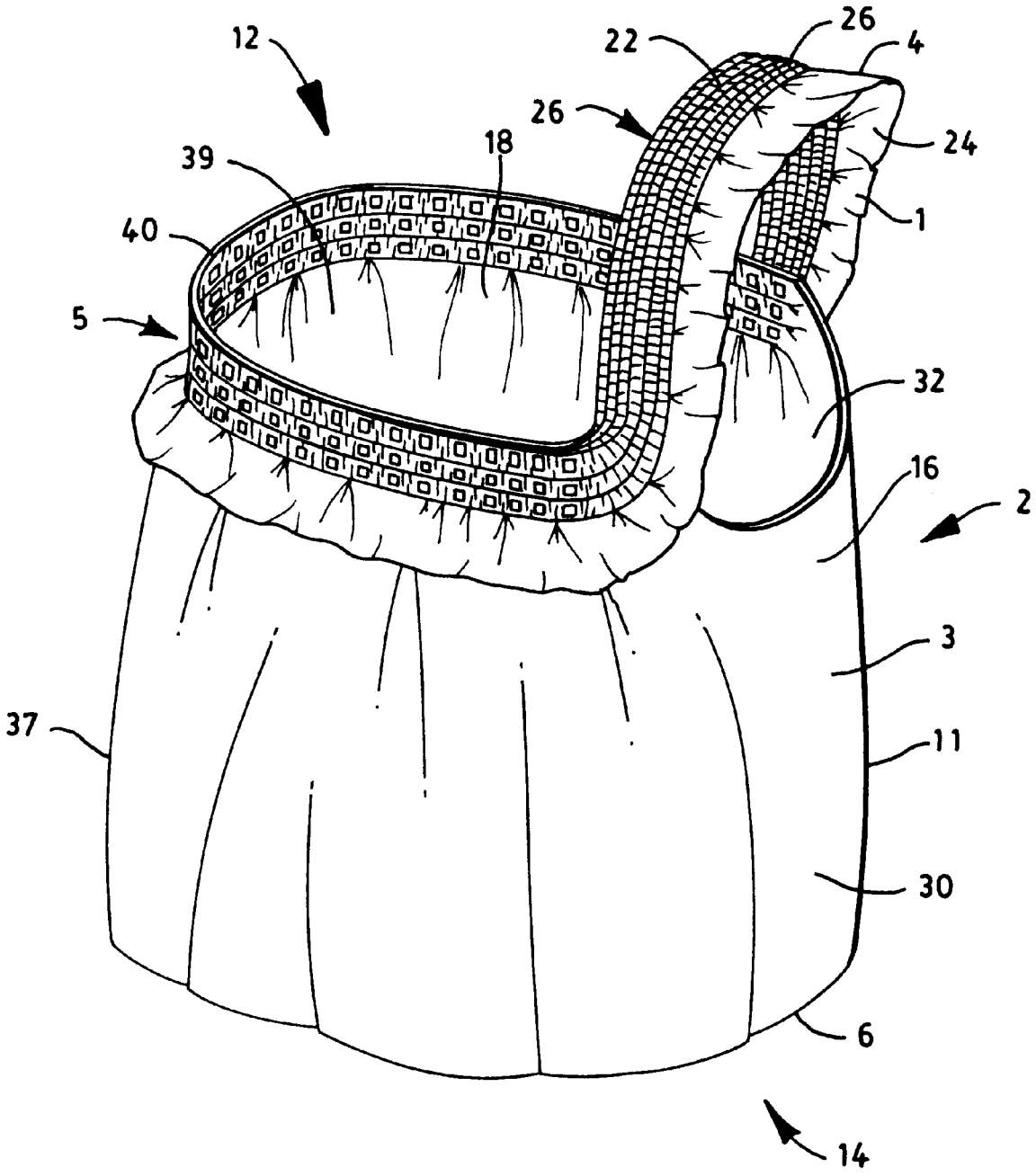
FIG. 2 is a front view of another embodiment of a camisole garment.
Figure 3:
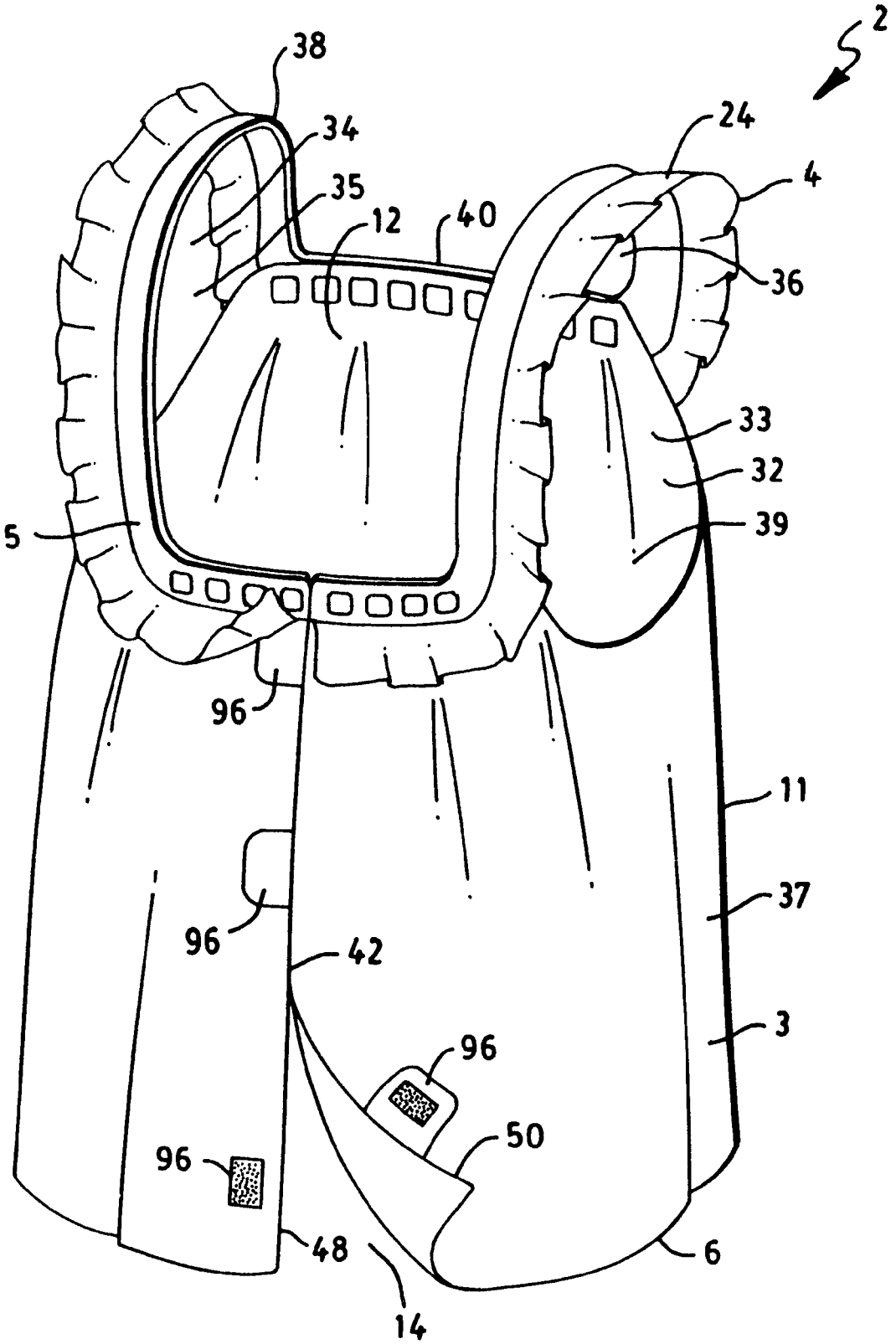
FIG. 3 is a back view of another embodiment of a camisole garment.

The present invention is a continuous process for the manufacture of a camisole garment 2 as shown in FIGS. 1, 2 and 3. The fabric 3, or material, used in the process may be a single layer web or a multi-layer laminate web. The fabric 3 is desirably a soft, flexible sheet.

One embodiment of the present invention is a continuous process for the manufacture of a camisole garment 2 (see FIG. 3) for wearing about the body comprising a top 10 having a body covering assembly 11, an upper body opening 12 and a lower body opening 14, each opening 12 and 14 having an edge 4 or 6, respectively, about its perimeter. The illustrated top 10 comprises a single layer web of fabric 3.

The single layer web of fabric 3 used in the process may be any suitable material, such as a woven material, a nonwoven material, a fibrous, or a polymeric film material and may include an elastic material. Suitable fibrous webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The web may also comprise a polymeric film layer such as polyethylene, polypropylene, polyamide, polyester, acrylic polymers, and compatible mixtures, blends and copolymers thereof.

The fabric 3 may be liquid pervious, permitting liquids to readily penetrate into its thickness, or impervious, resistant to the penetration of liquids into its thickness. The fabric 3 may also be made from a wide range of materials, such as natural fibers (e.g. rayon, wood, or cotton fibers), synthetic fibers (e.g. polyester or polypropylene fibers) or from a combination of natural and synthetic fibers or reticulated foams and apertured plastic films. The fabric 3 may be woven, nonwoven or film such as spunbonded, meltblown, bond-carded, or the like. A suitable fabric 3 is carded, and thermally bonded by means well known to those skilled in the fabric art.

The fabric 3 may be further dyed, pigmented, or imprinted with any suitable color. Desirably, the fabric 3 is either dyed, pigmented, or printed with a material which does not irritate or bleed the color onto the skin of the wearer.

A repeating series of pairs of openings 32 and 34 are cut into the fabric 3. The location of the openings 32 and 34 corresponds to the arm holes 33 and 35, respectively, in the finished garment 2. The openings 32 and 34 may be produced by a die cut operation, an ultrasonic operation, or any other suitable method of operation. The openings 32 and 34 can have a variety of shapes ranging from slit, circular, square, oval, irregular, or the like. The pattern is restricted only by fashion and the minimum amount of fabric 3 that must remain having a sufficient integrity to withstand the remaining steps or operations of the process of manufacture. The top edges 36 and 38 of the openings 32 and 34, respectively, may be located from about 0.25 inch to about 5.0 inches from the upper edge 4.

The portion of the fabric 3 of the body covering assembly 11 between the upper edge 4 and the openings 32 and 34 is folded back onto itself, thereby forming a neckline edge fold 40. In the desired embodiment, the fabric 3 is folded such that the folded material 5 lies on the outer surface 37 of the finished garment 2. In another embodiment, the fabric 3 is folded such that the folded material 5 lies on the inner surface 39 of the finished garment 2.

The folded material 5 is bonded between the openings 32 and 34, thereby creating shoulder straps 26 and 28. The shoulder straps 26 and 28 help hold the camisole garment 2 in place. The bonding forms a non-refastenable seam 42. The non-refastenable seam 42 may be formed by any suitable means such as ultrasonic sealing, adhesive bonding, heat sealing, tape, sewing, or the like accomplished on a continuous or intermittent basis. One suitable method of forming such seams is disclosed in U.S. Pat. No. 4,938,753 issued Jul. 3, 1990, to Van Gompel et al., which is incorporated herein by reference.

The fabric 3 is then cut into discrete garment-sized pieces wherein each piece contains one pair of openings 32 and 34, one pair of shoulder straps 26 and 28 and one pair of opposing end portions 48 and 50. Each piece of fabric 3 is transported, typically by vacuum screens, belts, or conveyors, through folding and redirection operations. Folding and redirection operations are desirably carried out by turn rolls and turn tables, as well as any other known means. The piece of fabric 3 is folded (desirably via a turn roll) so as to bring together the opposing end portions 48 and 50 to form a body seam 42. The piece of fabric 3 is redirected (or reoriented) to allow easy bonding of the body seam 42. The piece of fabric 3 is reoriented 90 degrees. The body seam 42 can be a non-refastenable seam or a refastenable seam. Any excess fabric 3 may be removed from the edge 47 of the body seam 42 to reduce and smooth out the body seam 42. The non-refastenable body seam 42 may be formed by any suitable means such as ultrasonic sealing, adhesive bonding, tape, heat sealing, sewing, or the like.

In other embodiments, the opposing end portions 48 and 50 of the top 10 may be held together in the finished top 10 to form a refastenable body seam 42. Refastenable means for securing the opposing end portions 48 and 50 of the top 10 include refastenable adhesive systems and mechanical type fasteners 96. Mechanical type fasteners include buttons, button holes, snaps, buckles, clasps, hooks and loops, end extensions, tabs, and the like which are designed or adapted to interlock or engage some type of a complimentary device or the outer cover 16 of the top 10. In addition, elasticized fasteners may also be used in assuring better fit of the camisole garment 2. If the camisole garment 2 includes a refastenable body seam 42, the refastenable means are desirably strategically placed on the fabric 3 before the fabric 3 is cut into discrete garment-sized pieces. The folding and redirection operations may be eliminated when a refastenable body seam 42 is included in the camisole garment 2. There may be packaging reasons for which one would still carry out these two steps.

Another embodiment of the present invention is a continuous process for the manufacture of a camisole garment 2 (see FIGS. 1 and 2) for wearing about the body comprising an elastic top 10 having a body covering assembly 11, an upper body opening 12 and a lower body opening 14, each opening 12 and 14 having an edge 4 or 6, respectively, about its perimeter. The top 10 comprises an outer cover 16 and bodyside liner 18 both of which generally cover a series of body elastics 20. The top 10 comprises a multi-layer laminate web of fabric 3.

Both the outer cover 16 and the bodyside liner 18 are desirably compliant and soft feeling to the wearer. The following description of materials from which the outer cover 16 may be formed may also be used to form the material of the bodyside liner 18.

The outer cover 16 may be any suitable gatherable material, such as a woven material, a nonwoven material, a fibrous or a polymeric film material and may be, although they need not necessarily be, an elastic material. Suitable fibrous gatherable webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The gatherable webs may also comprise polymeric film layers such as polyethylene, polypropylene, polyamide, polyester, acrylic polymers, and compatible mixtures, blends and copolymers thereof.

The outer cover 16 may be liquid pervious, permitting liquids to readily penetrate into its thickness, or impervious, resistant to the penetration of liquids into its thickness. Outer cover 16 may be made from a wide range of materials, such as natural fibers (e.g. rayon, wood, or cotton fibers), synthetic fibers (e.g. polyester or polypropylene fibers) or from a combination of natural and synthetic fibers or reticulated foams and apertured plastic films. The outer cover 16 may be woven, nonwoven or film such as spunbonded, carded, or the like. A suitable outer cover 16 is carded, and thermally bonded by means well known to those skilled in the fabric art.

Alternatively, the outer cover 16 may be derived from a spunbonded web. In a desired embodiment, the outer cover 16 is spunbonded polypropylene nonwoven, meltblown polypropylene nonwoven and spunbonded polypropylene nonwoven laminate (SMS). The total basis is from about 0.4 to about 1.0 osy (more desirably 0.6 osy) and is made with about 86% spunbonded nonwoven and 14% meltblown nonwoven. A pigment such as titanium dioxide may be incorporated into the outer cover 16 and bodyside liner 18. Such spunbonded meltblown nonwoven laminate material is available from Kimberly-Clark Corporation, Roswell, Ga. The basis weight of the SMS material may vary from about 0.4 to about 1.0 osy.

In other desired embodiments, the outer cover 16 is spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such spunbonded material is available from Kimberly-Clark Corporation, Roswell, Ga. The outer cover 16 has a weight of from about 0.5 oz. per square yard (osy) to about 1.5 osy, desirably about 0.7 osy.

The outer cover 16 may be constructed of a single spunbonded polypropylene nonwoven web having a basis weight of about 0.5 oz/yd$^2$ (17 gsm) to about 1.5 oz/yd$^2$ (51 gsm). In the structure of the top 10, the outer cover 16 desirably comprises a material having a basis weight of from about 0.5 oz/yd$^2$ (17 gsm) to about 1.5 oz/yd$^2$ (51 gsm). Lesser basis weights may be used in the other regions of the article. Since the camisole garment 2 is typically intended for active wear, the outer cover 16 or portions thereof, can be made of materials having a basis weight which is abrasion resistant.

The bodyside liner 18 may be any soft and flexible sheet. The bodyside liner 18 must permit submersion in fresh water or salt water or treated water (chlorinated or brominated) and still retain its integrity. Again, the bodyside liner 18 will desirably permit submersion in fresh water or salt water or treated water (chlorinated or brominated) and still retain its integrity. The bodyside liner 18 may comprise, for example, a nonwoven web or sheet of a spunbonded, meltblown or bonded-carded web composed of synthetic polymer filaments, such as polypropylene, polyethylene, polyesters or the like, or a web of natural polymer filaments such as rayon or cotton. The bodyside liner 18 may be selectively embossed or perforated with discrete slits or holes extending therethrough. Suitable adhesives for adhering the laminate layers can be obtained from Findley Adhesives, Inc. of Wauwatosa, Wis.

The outer cover 16 and bodyside liner 18 may be further dyed, pigmented, or imprinted with any suitable color. Desirably, the bodyside liner 18 is either dyed, pigmented, or printed with a material which does not irritate or bleed the color onto the skin of the wearer.

Materials suitable for use as the body elastics 20 include a wide variety, but not limited to, elastic threads, meltblown elastomeric polymers, yarn rubber, flat rubber (e.g. as bands), elastic tape, film-type rubber, polyurethane, and tape-like elastomer, or foam polyurethane or formed elastic scrim. Each body elastic 20 may be unitary, multi-part, or composite in construction. Threads or ribbons, where used, may be multiple and may be applied as a composite. The elastomerics used in the body elastics 20 may be latent and non-latent.

Desirably, the body elastics 20 are elongated to between about 50% to about 300%, desirably depending on the decitex of the elastic threads used to about 150%. The elongations may vary for separate elements and still be within the overall elongation for the composite of the elements comprising the body elastics 20.

The body elastics 20 circumferentially surround the body of the wearer to form a relatively elastic region 22 of the top 10. The body elastics 20 act independently to conform to the contours of various body types and builds. This provides a smooth, snug, and comfortable fit within a given chest size range.

About the lower body opening 14, below and adjacent the relatively elastic region 22, there is formed at the lower edge 6 a relatively inelastic lower edge region 30. In addition, about the upper body opening 12, above and adjacent the relatively elastic region 22, there is formed at the upper edge 4 a relatively inelastic upper edge region 24. The relatively inelastic upper edge region 24 and the relatively inelastic lower edge region 30 form areas of ruffles on the top 10. The relatively inelastic upper edge region 24 and relatively inelastic lower edge region 30 each have a width ranging from about 0.25 to about 4.0 inches. The widths of these regions 24 and 30 are independent of each other.

The desired width of the relatively inelastic upper edge region 24 and the relatively lower edge region 30 is from about 0.25 to about 2.0 inches, and more desirably, from about 0.25 to about 1.0 inch.

A repeating series of pairs of openings 32 and 34 are cut out of the relatively elastic region 22, of the fabric 3, desirably near the inelastic upper region 24. The location of the openings 32 and 34 correspond to the arm holes 33 and 35 in the finished garment 2. The top edges 36 and 38 of the openings 32 and 34, respectively, may be located from about 0.25 inch to about 2.0 inches below the relatively inelastic upper edge region 24.

The openings 32 and 34, as discussed above, can have a variety of shapes. The pattern is restricted only by fashion and the minimum amount of fabric 3 that must remain having sufficient integrity to withstand the remaining steps or operations of the process of manufacture. The openings 32 and 34 may be produced by a die cut operation, an ultrasonic operation, or any other suitable method of operation. The top edges 36 and 38 of the openings 32 and 34, respectively, may be located from about 0.25 inch to about 5.0 inches from the upper edge 4.

In a top 10 intended for a 25 pound girl, the body elastics 20 are about 16 inches (406 mm) long unstretched. For a top 10 that does not cover the girl's stomach, the height of the top 10 is about 5.75 inches (146 mm) wide. For a top 10 that does cover to the waist the height may be about 9.50 inches (229 mm) wide. If it does extend to the waist, the top 10 may be fastened to a bottom or pant-type garment.

The top 10 includes a pair of shoulder straps 26 and 28 which help hold the camisole garment 2 in place. The shoulder straps 26 and 28 are made of the fabric 3 located between the top edges 36 and 38 of the arm holes 32 and 34 and the upper edge 4. The portion of the fabric 3 is folded such that the folded material 5 lies on the outer surface 37 of the finished garment 2, wherein the outer cover 16 is folded back onto itself, exposing a portion of the bodyside liner 18 and creating a neckline edge fold 40. In an alternative embodiment, the portion of the fabric 3 is folded such that the folded material 5 lies on the inner surface 39 of the finished garment 2, wherein the bodyside liner 18 is folded back onto itself, positioning a portion of the outer cover 16 against the body of the wearer.

The neckline edge fold 40 is maintained by bonding the folded material 5 to the fabric 3 between the openings 32 and 34, thereby creating the shoulder straps 26 and 28. The bonding forms a non-refastenable seam 42. The non-refastenable seam 42 may be formed by any suitable means such as ultrasonic sealing, adhesive bonding, heat sealing, or the like, as discussed above.

The fabric 3 is then cut into discrete garment-sized pieces wherein each piece contains one pair of openings 32 and 34, one pair of shoulder straps 26 and 28 and one pair of opposing end portions 48 and 50. Each piece of fabric 3 is transported, typically by vacuum screens, belts, or conveyors, through folding and redirection operations. The piece of fabric 3 is folded so as to bring together the opposing end portions 48 and 50 to form a body seam 42.

The piece of fabric 3 is redirected (or reoriented) to allow easy bonding of the body seam 42. The body seam 42 can be a non-refastenable seam or a refastenable seam. Any excess fabric 3 may be removed from the edge 47 of the body seam 42 to reduce and smooth out the body seam 42. The non-refastenable body seam 42 may be formed by any suitable means such as ultrasonic sealing, adhesive bonding, heat sealing, or the like, as discussed above.

In other embodiments, the opposing end portions 48 and 50 of the top 10 may be held together in the finished top 10 to form a refastenable body seam 42. Refastenable means for securing the opposing end portions 48 and 50 of the top 10 include refastenable adhesive systems and mechanical type fasteners. Mechanical type fasteners include buttons, button holes, snaps, buckles, clasps, hooks and loops, end extensions, tabs, and the like which are designed or adapted to interlock or engage some type of a complimentary device or the outer cover 16 of the top 10.

In addition, elasticized fasteners may also be used in assuring better fit of the camisole garment 2. If the camisole garment 2 includes a refastenable body seam 42, the refastenable means are desirably strategically placed on the fabric 3 before the fabric 3 is cut into discrete garment-sized pieces. The folding and redirection operations are eliminated when a refastenable body seam 42 is included in the camisole garment 2.

The fabric 3 of the top 10 desirably has stretch characteristics in a first direction such that it is capable of from about 10 to about 500 percent elongation and upon release of tension will recover at least 55 percent of its elongation. It is generally desired that the structure material of the top 10 in the first direction be capable of between about 50 and about 300 percent elongation, particularly at least 125 percent elongation and recovery upon release of tension of at least 80 percent of its elongation.

As described previously, the top 10 may be formed of a material capable of stretching in one direction or capable of stretching in at least two substantially perpendicular directions. One suitable one-directional stretch material is disclosed in U.S. Pat. No. 4,720,415 issued Jan. 19, 1988, to Vander Wielen et al., which is incorporated herein by reference.

The one-directional stretch material may comprise a composite material including at least one gatherable web bonded to at least one elongated elastic web. The elastic web may be an elastic film or nonwoven fibrous elastic webs such as meltblown elastomeric fibrous webs. In one embodiment, the top 10 comprises a stretch bonded laminate formed of a pre-stretched elastic meltblown inner layer sandwiched between and attached to a pair of spunbond polypropylene nonwoven webs each having a basis weight of about 0.4 oz/yd$^2$ (13.6 gsm). Suitable elastic materials can be purchased from the Shell Chemical Company of Houston, Tex. under the trade name Kraton. Other suitable one-directional stretch materials are disclosed in U.S. Pat. Nos. 4,606,964 issued Aug. 19, 1986, to Wideman and 4,657,802 issued Apr. 14, 1987, to Morman.

Suitable two-directional stretch materials for the body elastics 20 are disclosed in U.S. Pat. Nos. 5,114,781 issued May 19, 1992, and 5,116,662 issued May 26, 1992, to Morman, which are incorporated herein by reference. A two-directional stretch material may comprise a composite material including a neckable material and an elastic sheet, which may be formed by meltblowing or extrusion. Neckable materials are those which may be constricted in at least one dimension by applying a tensioning force in a direction perpendicular to the desired direction of neck-down, and may include a spunbonded, meltblown or bonded carded web. The tensioned, necked neckable material may be joined to the elongated elastic sheet at spaced locations arranged in a nonlinear configuration.

Another two-directional stretch composite material may comprise one or more layers of reversibly necked material joined to one or more layers of elastic sheet at spaced locations. Reversibly necked materials are those that have been treated, such as with heat, while necked to impart memory to the material so that, when a force is applied to extend the material to its pre-necked dimensions, the treated, necked portions will generally recover to their necked dimensions upon termination of the force.

Desirably, the material stretches in horizontal direction only, that is, around the body. If the material is elastic in both directions, it is desirable to limit the stretch in the vertical direction to less than about 20% under normal tensions.

Alternately, the body elastics 20 may be formed of a dry-spun coalesced multi-filament elastomeric thread sold under the tradename LYCRA and available from I. E. Du Pont de Nemours and Company. Still alternately, the elastics may be formed of other typical elastics utilized in the diaper-making art, such as a thin ribbon of elastic material as disclosed in U.S. Pat. No. 4,940,464 issued Jul. 10, 1990, to Van Gompel et al., which is incorporated herein by reference. Elasticity could also be imparted to the structure material of the top 10 by extruding a hot melt elastomeric adhesive between the outer cover 16 and the bodyside liner 18. Other suitable elastic gathering means are disclosed in U.S. Pat. Nos. 4,938,754 to Mesek and 4,388,075 to Mesek et al.

In forming the top 10 structure material, the body elastics 20 may be individually laid on one of the adjacent gatherable layers (outer cover 16 or bodyside liner 18) and the other gatherable layer web applied over the elastics to bond the first layer. Alternatively, only one gatherable layer, e.g., the outer cover 16, may be employed and the body elastics 20 bonded to one side, desirably the bodyside, of the outer cover 16. In such an embodiment, the body elastics 20 are left exposed on one side of the outer cover 16.

One embodiment of the present invention relates to a continuous process for the manufacture of a camisole garment 10 comprising:

a. providing a single layer web of fabric 3 including an upper edge 4, a lower edge 6, and a body covering assembly 11;

b. intermittently cutting the fabric 3, defining openings 32 and 34 in the fabric 3 wherein each opening 32 and 34 includes a top edge 36 and 38 adjacent to the upper edge 4 of the fabric 3;

c. folding at least a portion of the fabric 3 between at least one of the openings 32 and 34 and the upper edge 4 of the fabric 3 back onto the body covering assembly 11 of the fabric 3 wherein at least one shoulder strap 26 is formed;

d. fastening the folded portion of the fabric 3 to the body covering assembly 11 of the fabric 3 to form a neckline fold 40;

e. cutting the fabric 3, defining discrete garment-sized pieces wherein each piece of fabric 3 includes at least one opening 32, at least one shoulder strap 26, and two opposing end portions 48 and 50;

f. folding the discrete garment-sized piece of fabric 3 whereby the two opposing end portions 48 and 50 are brought into contact with each other;

g. turning the folded discrete garment-sized piece of fabric 3 to move sideways; and, h. fastening the two opposing end portions 48 and 50 together to form a body seam 42.

The continuous process may further comprise cutting off excess fabric 3 remaining of the two opposing end portions 48 and 50 adjacent to the body seam 42. At least one pair of openings 32 and 34 are cut into the fabric 3. The body seam 42 can be refastenable or non-refastenable.

Another embodiment of the present invention relates to a continuous process for the manufacture of a camisole garment 10 comprising:

a. providing a multi-layer laminate web of fabric 3 including an upper edge 4, a lower edge 6, and a body covering assembly 11;

b. intermittently cutting the fabric 3, defining openings 32 and 34 in the fabric 3 wherein each opening 32 and 34 includes a top edge 36 and 38 adjacent to the upper edge 4 of the fabric 3;

c. folding at least a portion of the fabric 3 between at least one of the openings 32 and the upper edge 4 of the fabric 3 back onto the body covering assembly 11 of the fabric 3 wherein at least one shoulder strap 26 is formed;

d. fastening the folded portion of the fabric 3 to the body covering assembly 11 of the fabric 3;

e. cutting the fabric 3, defining discrete garment-sized pieces of fabric 3 wherein each piece of fabric 3 includes at least one opening 32, at least one shoulder strap 26, and two opposing end portions 48 and 50;

f. folding the discrete garment-sized piece of fabric 3 whereby the two opposing end portions 48 and 50 are brought into contact with each other;

g. turning the folded discrete garment-sized piece of fabric 3 to move sideways; and, h. fastening the two opposing end portions 48 and 50 together to form a body seam 42.

The continuous process may further comprise cutting off the excess fabric 3 remaining on the two opposing end portions 48 and 50 adjacent to the body seam 42. The body covering assembly 11 comprises a relatively elastic region 22 between a relatively inelastic lower edge region 30 adjacent to the lower edge 6 of the fabric 3 and a relatively inelastic upper edge region 24 adjacent to the upper edge 4 of the fabric 3. The relatively elastic region 22 comprises body elastics 20 between an outer cover 16 and a bodyside liner 18 and in which the body elastics 20 circumferentially surround a body of a wearer.

The present invention also relates to a continuous process for the manufacture of a camisole garment 10 comprising:

a. providing a single layer web of fabric 3 including an upper edge 4, a lower edge 6, and a body covering assembly 11;

b. intermittently cutting the fabric 3, defining openings 32 and 34 in the fabric 3 wherein each opening 32 and 34 includes a top edge 36 and 38 adjacent to the upper edge 4 of the fabric 3;

c. folding at least a portion of the fabric 3 between at least one of the openings 32 and 34 and the upper edge 4 of the fabric 3 back onto the body covering assembly 11 of the fabric 3 wherein at least one pair of shoulder straps 26 and 28 are formed;

d. fastening the folded portion of the fabric 3 to the body covering assembly 11 of the fabric 3 to form a neckline fold 40;

e. cutting the fabric 3, defining discrete garment-sized pieces of fabric 3 wherein each piece of fabric 3 includes at least one pair of openings 32 and 34, at least one pair of shoulder straps 26 and 28, and two opposing end portions 48 and 50; and, f. folding the discrete garment-sized piece of fabric 3 whereby the two opposing end portions 48 and 50 are brought into contact with each other.

However, the discrete garment-sized piece of fabric 3 does not need to be folded, nor does the two opposing end portions 48 and 50 have to be brought into contact with each other during the process of the present invention. The mechanical fasteners 96, when used, can be applied during the process of the present invention and the opposing end portions 48 and 50 need never be brought into contact with each other prior to use.

The continuous process may further comprise cutting off excess fabric 3 remaining of the two opposing end portions 48 and 50 adjacent to the body seam 42. The body seam 42 may be refastenable or non-refastenable. The continuous process may also further comprise turning the folded discrete garment-sized piece of fabric 3 to move sideways.

The present invention relates to a continuous process for the manufacture of a camisole garment 10 comprising:

a. providing a multi-layer laminate web of fabric 3 including an upper edge 4, a lower edge 6, and a body covering assembly 11;

b. intermittently cutting the fabric 3 defining openings 32 and 34 in the fabric 3 wherein each opening 32 and 34 includes a top edge 36 and 38 adjacent to the upper edge 4 of the fabric 3;

c. folding at least a portion of the fabric 3 between at least one of the openings 32 and 34 and the upper edge 4 of the fabric 3 back onto the body covering assembly 11 of the fabric 3 wherein at least one pair of shoulder straps 26 and 28 are formed;

d. fastening the folded portion of the fabric 3 to the body covering assembly 11 of the fabric 3;

e. cutting the fabric 3, defining discrete garment-sized pieces of fabric 3 wherein each piece of fabric 3 includes at least one pair of opposing openings 32 and 34, at least one pair of shoulder straps 26 and 28, and two opposing end portions 48 and 50; and, f. folding the discrete garment-sized piece of fabric 3 whereby the two opposing end portions 48 and 50 are brought into contact with each other.

Although the fabric 3 for use in the present invention is generally intended to be disposable, any fabric 3 which is reusable may be used in this invention. Thus, both reusable and disposable items (the latter term meaning items intended to be discard after a single use rather than being laundered and reused) can be made in accordance with the present invention.

The foregoing detailed description has been for the purpose of illustration. Thus, a number of modifications and changes may be made without departing from the spirit and scope of the present invention. For instance, alternative or optional features described as part of one embodiment can be used to yield another embodiment. Therefore, the invention should not be limited by the specific embodiments described, but only by the claims.

What is claimed is:

1. A continuous process for the manufacture of a camisole garment comprising:

a. providing a single layer web of fabric including an upper edge, a lower edge, and a body covering assembly;

b. intermittently cutting the fabric, defining openings in the fabric wherein each opening includes a top edge adjacent to the upper edge of the fabric;

c. folding at least a portion of the fabric between at least one of the openings and the upper edge of the fabric back onto the body covering assembly of the fabric wherein at least one shoulder strap is formed;

d. fastening the folded portion of the fabric to the body covering assembly of the fabric to form a neckline fold;

e. cutting the fabric, defining discrete garment-sized pieces wherein each piece of fabric includes at least one opening, at least one shoulder strap, and two opposing end portions;

f. folding the discrete garment-sized piece of fabric whereby the two opposing end portions are brought into contact with each other;

g. turning the folded discrete garment-sized piece of fabric to move sideways; and, h. fastening the two opposing end portions together to form a body seam.

2. The continuous process according to claim 1, further comprising cutting off excess fabric remaining of the two opposing end portions adjacent to the body seam.

3. The continuous process according to claim 1, wherein at least one pair of opening are cut into the fabric.

4. The continuous process according to claim 1, wherein the body seam is refastenable.

5. The continuous process according to claim 1, wherein the body seam is non-refastenable.

6. A continuous process for the manufacture of a camisole garment comprising:

a. providing a multi-layer laminate web of fabric including an upper edge, a lower edge, and a body covering assembly;

b. intermittently cutting the fabric, defining openings in the fabric wherein each opening includes a top edge adjacent to the upper edge of the fabric;

c. folding at least a portion of the fabric between at least one of the openings and the upper edge of the fabric back onto the body covering assembly of the fabric wherein at least one shoulder strap is formed;

d. fastening the folded portion of the fabric to the body covering assembly of the fabric;

e. cutting the fabric, defining discrete garment-sized pieces of fabric wherein each piece of fabric includes at least one opening, at least one shoulder strap, and two opposing end portions;

f. folding the discrete garment-sized piece of fabric whereby the two opposing end portions are brought into contact with each other;

g. turning the folded discrete garment-sized piece of fabric to move sideways; and, h. fastening the two opposing end portions together to form a body seam.

7. The continuous process according to claim 6, further comprising cutting off excess fabric remaining of the two opposing end portions adjacent to the body seam.

8. The continuous process according to claim 6, wherein the body covering assembly comprises a relatively elastic region between a relatively inelastic lower edge region adjacent to the lower edge of the fabric and a relatively inelastic upper edge region adjacent to the upper edge of the fabric.

9. The continuous process according to claim 8, wherein the relatively elastic region comprises body elastics between an outer cover and a bodyside liner and in which the body elastics circumferentially surround a body of a wearer.

10. A continuous process for the manufacture of a camisole garment comprising:

a. providing a single layer web of fabric including an upper edge, a lower edge, and a body covering assembly;

b. intermittently cutting the fabric, defining openings in the fabric wherein each opening includes a top edge adjacent to the upper edge of the fabric;

c. folding at least a portion of the fabric between at least one of the openings and the upper edge of the fabric back onto the body covering assembly of the fabric wherein at least one pair of shoulder straps are formed;

d. fastening the folded portion of the fabric to the body covering assembly of the fabric to form a neckline fold;

e. cutting the fabric, defining discrete garment-sized pieces of fabric wherein each piece of fabric includes at least one pair of openings, at least one pair of shoulder straps, and two opposing end portions.

11. The continuous process according to claim 10, further comprising cutting off excess fabric remaining of the two opposing end portions adjacent to the body seam.

12. The continuous process according to claim 10, wherein the body seam is refastenable.

13. The continuous process according to claim 10, wherein the body seam is non-refastenable.

14. The continuous process according to claim 10, further comprising turning the folded discrete garment-sized piece of fabric to move sideways.

15. The continuous process according to claim 14, further comprising fastening the two opposing end portions together to form a body seam.

16. The continuous process according to claim 15, further comprising cutting off excess fabric remaining of the two opposing end portions adjacent to the body seam.

17. The continuous process according to claim 15, wherein the body seam is refastenable.

18. The continuous process according to claim 15, wherein the body seam is non-refastenable.

19. A continuous process for the manufacture of a camisole garment comprising:

a. providing a multi-layer laminate web of fabric including an upper edge, a lower edge, and a body covering assembly;

b. intermittently cutting the fabric defining openings in the fabric wherein each opening includes a top edge adjacent to the upper edge of the fabric;

c. folding at least a portion of the fabric between at least one of the openings and the upper edge of the fabric back onto the body covering assembly of the fabric wherein at least one pair of shoulder straps are formed;

d. fastening the folded portion of the fabric to the body covering assembly of the fabric;

e. cutting the fabric, defining discrete garment-sized pieces of fabric wherein each piece of fabric includes at least one pair of opposing openings, at least one pair of shoulder straps, and two opposing end portions.

20. The continuous process according to claim 19, further comprising cutting off excess fabric remaining of the two opposing end portions adjacent to the body seam.

21. The continuous process according to claim 19, wherein the body covering assembly comprises a relatively elastic region between a relatively inelastic lower edge region adjacent to the lower edge of the fabric and a relatively inelastic upper edge region adjacent to the upper edge of the fabric.

22. The continuous process according to claim 21, wherein the relatively elastic region comprises body elastics between an outer cover and a bodyside liner and in which the body elastics circumferentially surround a body of a wearer.

23. The continuous process according to claim 21, further comprising cutting off excess fabric remaining of the two opposing end portions adjacent to the body seam.

24. The continuous process according to claim 21, wherein the body seam is refastenable.

25. The continuous process according to claim 21, wherein the body seam is non-refastenable.

26. The continuous process according to claim 21, further comprising turning the folded discrete garment-sized piece of fabric to move sideways.

27. The continuous process according to claim 26, further comprising fastening the two opposing end portions together to form a body seam.

28. The continuous process according to claim 27, further comprising cutting off excess fabric remaining of the two opposing end portions adjacent to the body seam.

29. The continuous process according to claim 27, wherein the body seam is refastenable.

30. The continuous process according to claim 27, wherein the body seam is non-refastenable.

* * * * *